US005514524A

United States Patent [19]

Ohnishi et al.

[11] Patent Number: 5,514,524

[45] Date of Patent: May 7, 1996

[54] METHOD OF MAKING THERMAL PRINTHEAD

[75] Inventors: Hiroaki Ohnishi; Toshihiko Takakura; Toshiyuki Fujita, all of Kyoto, Japan

[73] Assignee: Rohm Co., Ltd., Kyoto, Japan

[21] Appl. No.: 345,705

[22] Filed: Nov. 21, 1994

[30] Foreign Application Priority Data

Nov. 22, 1993 [JP] Japan ..... 5-292275
Dec. 28, 1993 [JP] Japan ..... 5-335146

[51] Int. Cl.[6] ..... B41J 2/335

[52] U.S. Cl. ..... 430/320; 430/5; 347/201; 347/202; 29/611

[58] Field of Search ..... 347/201, 202; 29/611; 430/320, 5

[56] References Cited

U.S. PATENT DOCUMENTS 4,777,583 10/1988 Minami et al. ..... 347/202
4,861,625 8/1989 Kondo et al. ..... 29/611
4,973,986 11/1990 Narita ..... 347/202
5,109,238 4/1992 Watanabe et al. ..... 347/202
5,231,420 7/1993 Yamamoto et al. ..... 29/611
5,317,341 5/1994 Tatsumi ..... 29/611
5,367,320 11/1994 Taniguchi et al. ..... 347/202
5,373,625 12/1994 Shirasaki ..... 29/611

FOREIGN PATENT DOCUMENTS 4-244861 9/1992 Japan ..... B41J 2/335

*Primary Examiner*—Mark F. Huff
*Attorney, Agent, or Firm*—Michael D. Bednarek

[57] ABSTRACT

A method of making thermal printheads is provided which comprises the steps of: (a) preparing a master substrate having plural rows of unit head regions; (b) forming a head glaze member in each unit head region in each row so that an edge of the head glaze member of the unit head region aligned with that of the head glaze member of any other unit region in the same row; (c) half-cutting the master substrate along the edge of the head glaze member of the unit head region with a half-cutting dicing blade which has an inclined edge face for partially cutting the head glaze member to provide a glaze corner; and (d) forming an array of heating dots along the glaze corner; wherein at least one blade positioning mark is formed on the master substrate before the half-cutting step (c); and the half-cutting dicing blade is positionally set in the half-cutting step (c) by referring to the blade positioning mark.

10 Claims, 13 Drawing Sheets

METHOD OF MAKING THERMAL PRINTHEAD

BACKGROUND OF THE INVENTION

1. Field of the Invention

The present invention relates to a method of making thermal printheads. More specifically, the present invention relates to a method of making thermal printheads of the type which comprise a glaze corner for carrying an array of heating dots therealong.

2. Description of the Prior Art

A thermal printhead of the above-described type is disclosed in Japanese Patent Application Laid-open No. 4(1992)-244861 for example. Such a printhead may be incorporated in a heat sensitive printer, thermal transfer printer, labelling printer, facsimile, word processor, typewriter, card printer, image printer, time recorder or the like.

For the convenience of description, reference is now made to FIGS. 20 through 22 showing a prior art thermal printhead.

The prior art printhead 3" shown in FIG. 20 is a serial-type printhead which comprises a head substrate 1" and a printing portion 2" provided on the head substrate 1". As shown in FIG. 21, the printing portion 2" is provided at a head glaze strip 4" formed on the head substrate 1" adjacent to one longitudinal edge thereof. The glaze strip 4" is formed to have a corner 11 which is relatively sharp for concentrating contact pressure relative to an article (e.g. paper) being printed.

As shown in FIGS. 21 and 22, a patterned resistor layer 5" is formed on the head substrate 1" and glaze strip 4", whereas a patterned conductor layer is formed on the resistor layer 5" to provide a common electrode 6" and a plurality of individual electrodes 7". The individual electrodes 7" are spaced from the common electrode 6" at the corner 11" of the glaze strip 4", so that the patterned resistor layer 5" provides an array of heating dots 8" along the corner 11" of the glaze strip 4". Further, a protective layer 24" of glass for example is formed on the patterned conductor layer 6", 7".

The thermal printhead having the above structure may be manufactured in the following manner.

First, as shown in FIG. 23, a master substrate 10" made of an insulating material is prepared. The master substrate 10" has plural rows (e.g. three rows) of unit head regions 9" which are subsequently separated from each other by cutting. Apparently, each of the unit head regions 9" corresponds to a head substrate (see the element 1" in FIG. 20). Further, the master substrate 10" is provided with a pair of positioning marks 14".

Then, as also shown in FIG. 23, head glaze strips 4" are formed on the master substrate 10" in the respective unit head regions 9" adjacent to and along their corresponding longitudinal edges. As a result, the glaze strips 4" in each row are longitudinally aligned.

The head glaze strips 4" may be formed by printing a glass paste with the use of a screen (not shown) and thereafter baking the glass paste for curing. Due to the surface tension of the glass paste, each of the strips 4" will have a generally arcuate outer surface, as shown in FIG. 24.

Then, as shown in FIG. 25*a* or 25*b*, the master substrate 10 is subjected to a corner forming step along each of the head glaze strips 4". In this step, an inclined cut surface 26 is formed to provide a corner 11" at the glaze strip 4".

Then, a uniform resistor layer (not shown) is formed on the master substrate 10" in each unit head region 9", and a uniform conductor layer (not shown) is formed on the resistor layer.

Then, the resistor layer together with the conductor layer is etched in a predetermined pattern (see FIGS. 21 and 22) by photolithography. In this step, a resist layer (not shown) is first formed on the conductor layer, and the resistor layer is patterned by using a photomask. The photomask has an alignment mark 12" (See FIG. 26) for alignment with each of the positioning marks 14" of the master substrate 10" (FIG. 23), thereby facilitating the mask alignment.

Finally, a protective layer 24" (see FIG. 21) is formed by a known step on the patterned resistor layer 5" and patterned conductor layer 6", 7" in each unit head region 9" (see FIG. 23), and the master substrate 10" is fully cut to separate the respective unit head regions 9".

According to the method described above, it is preferable to perform the corner forming step in a manner such that the formed corner 11" is located at the widthwise center of each glaze strip 4" or slightly offset inwardly from the widthwise center. However, it has been found that production errors are likely to occur at the time of performing the corner forming step if no countermeasure is taken. For instance, the glaze corner 11" may be positionally offset laterally outwardly from the widthwise center of the glaze strip 4", as shown in FIG. 25*a*. In this case. the glaze corner 11" is insufficiently sharp and therefore fails to provide an intended contact pressure concentration for improving the printing quality. Further, the volume of the glaze strip 4" may be excessively large, which also deteriorates the printing quality.

Conversely, it is also possible that the glaze corner 11" be offset excessively inwardly from the widthwise center of the glaze strip 4", as shown in FIG. 25*b*. In this case, the volume of the glaze strip 4" is too small to provide an intended heat retaining function, thereby failing to improve the printing quality. Further, the inclined cut surface 26" of the substrate 10" may be followed by an unwanted platform 13" which may come into damaging contact with an ink ribbon or printing paper.

Moreover, since the mask alignment for the etching or photolithography step is performed by referring to each positioning mark 14" but not the glaze corner 11" itself, the array of heating dots 8" formed by the etching step may positionally deviate from the glaze corner 11" if the glaze corner 11" itself deviates positionally in the preceding corner forming step. Apparently, such a positional deviation of the heating dots array 8" will also results in a deterioration of the printing quality.

SUMMARY OF THE INVENTION

It is, therefore, an object of the present invention to provide a method of making thermal printheads by which each printhead is made to have a glaze corner with positional accuracy, thereby equalizing the printing quality from printhead to printhead.

It is also preferrable if an array of heating dots can be formed with positional accuracy relative to the glaze corner.

According to one aspect of the present invention, there is provided a method of making thermal printheads comprising the steps of:

(a) preparing a master substrate having plural rows of unit head regions;

(b) forming a head glaze member in each unit head region in each row so that an edge of the head glaze member of said each unit head region is aligned with that of the head glaze member of any other unit region in said each row;

(c) half-cutting the master substrate along said edge of the head glaze member of said each unit head region with a half-cutting dicing blade which has an inclined edge face for partially cutting the head glaze member to provide a glaze corner; and (d) forming an array of heating dots along the glaze corner;

wherein at least one blade positioning mark is formed on the master substrate before the half-cutting step (c); and wherein the half-cutting dicing blade is positionally set in the half-cutting step (c) by referring to the blade positioning mark.

With the method described above, the half-cutting dicing blade can be correctly positioned relative to the master substrate by referring to the blade positioning mark. Thus, the glaze corner formed by the dicing blade can be reliably and stably formed at a suitable position of each head glaze member.

Preferably, at least one cut width confirmation mark may be additionally formed on the master substrate before the half-cutting step (c). Since the inclined edge face of the half-cutting dicing blade is used to form the glaze corner on each head glaze member, the cut width or depth formed by the dicing blade influences the position of the glaze corner. Thus, the cut width confirmation mark is conveniently usable for confirming whether the cut width (which is indirectly indicative of the glaze corner position) is proper. If the cut width is found improper, re-adjustment of the cut width (or depth) or replacement of the dicing blade can be immediately performed.

Further, a glaze corner confirmation mark may be advantageously formed on the head glaze member of at least one unit head region before the half-cutting step (c). Since the glaze corner confirmation mark is formed directly on the head glaze member, it is directly indicative as to the position of the glaze corner and therefore usable for re-adjustment of the half-cutting condition or replacement of the dicing blade. Apparently, the glaze corner confirmation mark may be provided either in place of or in addition to the cut width confirmation mark described above.

Alternatively, at least one dummy glaze member may be also formed on the master substrate in the step (b) in a manner such that an edge of the dummy glaze member is aligned with that of the head glaze member of any unit region in a selected row. In this case, a glaze corner confirmation mark may be formed on the dummy glaze member before the half-cutting step (c).

According to a preferred embodiment of the present invention, the step (d) of forming the array of heating dots is performed by photolithography which comprises: irradiating light beams toward the glaze corner in at least one unit head region to form a highlight band; and positioning a photomask relative to the master substrate by referring to the highlight band. With this embodiment, the mask alignment required for forming the array of heating dots can be accurately performed by referring to the highlight band. Thus, even if the glaze corner slightly deviates from an exactly correct position, the heating dots array can be accurately formed at the glaze corner, thereby still ensuring a good printing quality.

Alternatively, at least one dummy glaze member is also formed on the master substrate in the step (b) in a manner such that an edge of the dummy glaze member is aligned with that that of the head glaze member of any unit region in a selected row, and the half-cutting step (c) is performed in a manner such that a glaze corner is also formed on the dummy glaze member in alignment with the glaze corner of any unit region in said selected row. In this case, the step (d) of forming the array of heating dots may be performed by photolithography which comprises: irradiating light beams toward the glaze corner of the dummy glaze member to form a highlight band; and positioning a photomask relative to the master substrate by referring to the highlight band.

According to another aspect of the present invention, there is provided a method of making thermal printheads comprising the steps of:

(a) preparing a master substrate having plural rows of unit head regions;

(b) forming a head glaze member in each unit head region in each row so that an edge of the head glaze member of said each unit head region is aligned with that of the head glaze member of any other unit region in said each row;

(c) half-cutting the master substrate along said edge of the head glaze member of said each unit head region with a half-cutting dicing blade which has an inclined edge face for partially cutting the head glaze member to provide a glaze corner; and (d) forming an array of heating dots along the glaze corner;

wherein the step (d) of forming the array of heating dots is performed by photolithography which comprises:

irradiating light beams toward the glaze corner in at least one unit head region to form a highlight band; and positioning a photomask relative to the master substrate by referring to the highlight band.

Since the highlight band is formed at the glaze corner regardless of its position, the mask alignment required for forming the array of heating dots can be accurately performed relative to the glaze corner. Thus, it is possible to form the heating dots array accurately at the glaze corner even if the position of the glaze corner deviates due to some error at the time of performing the half-cutting step (c).

According to a further aspect of the present invention, there is provided a method of making thermal printheads comprising the steps of:

(a) preparing a master substrate having plural rows of unit head regions;

(b) forming a head glaze member in each unit head region in each row so that an edge of the head glaze member of said each unit head region is aligned with that of the head glaze member of any other unit region in said each row;

(c) half-cutting the master substrate along said edge of the head glaze member of said each unit head region with a half-cutting dicing blade which has an inclined edge face for partially cutting the head glaze member to provide a glaze corner; and (d) forming an array of heating dots along the glaze corner;

wherein the step (b) further comprises forming at least one dummy glaze member on the master substrate in a manner such that an edge of the dummy glaze member is aligned with that that of the head glaze member of any unit region in a selected row;

wherein the half-cutting step (c) is performed in a manner such that a glaze corner is also formed on the dummy glaze member in alignment with the glaze corner of any unit region in said selected row; and wherein the step (d) of forming the array of heating dots is performed by photolithography which comprises:

irradiating light beams toward the glaze corner of the dummy glaze member to form a highlight band; and positioning a photomask relative to the master substrate by referring to the highlight band.

Apparently, since the glaze corner of the dummy glaze member is in alignment with the glaze corner of any unit head region in the selected row, the mask alignment can be also performed accurately relative to the master substrate by referring to the highlight band formed at the glaze corner of the dummy glaze member.

Preferably, the step (d) of forming the array of heating dots may further comprise simultaneously forming a heating dots confirmation pattern at the glaze corner of the dummy glaze member. In this case, when the glaze corner of the dummy glaze member is irradiated with light beams, a highlight band is formed which can be referred to for confirming whether the array of heating dots is correctly positioned.

Other object, features and advantages of the present invention will become apparent from the following detailed description of preferred embodiments made with reference to the accompanying drawings.

DETAILED DESCRIPTION OF THE PREFERRED EMBODIMENTS

Figure 1:
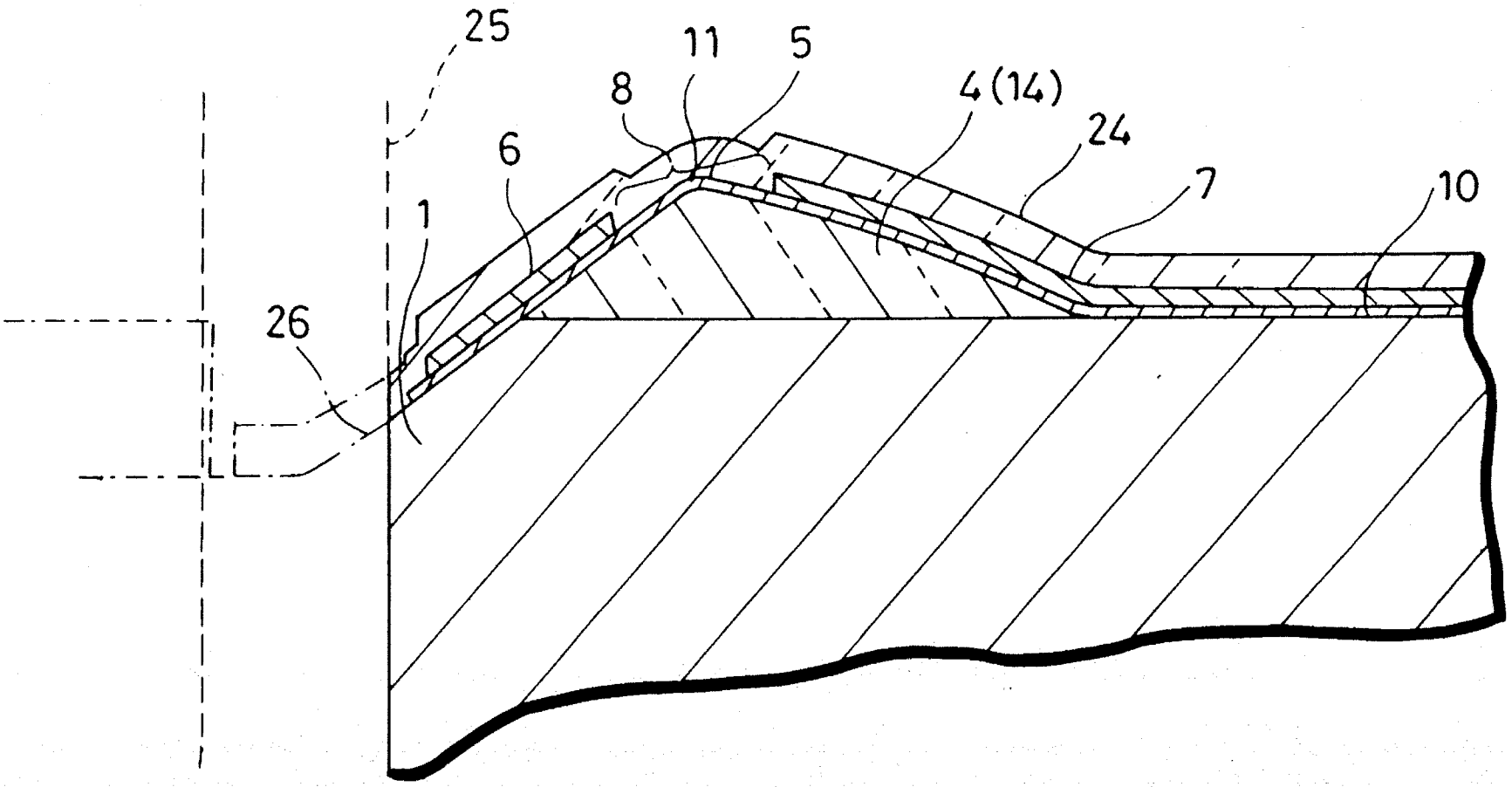
FIG. 1 is a transverse sectional view showing a serial-type thermal printhead which can be advantageously made by a method according to the present invention.
Figure 21:
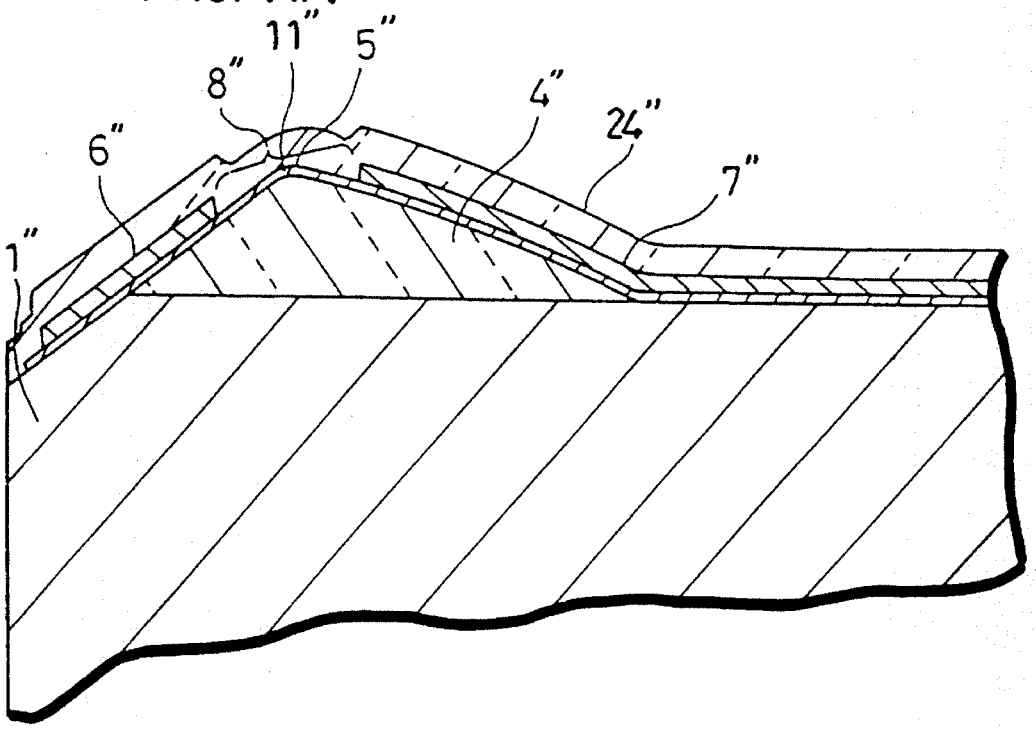
Fig. 21 Prior Art
FIG. 21 is a sectional view of the prior art printhead taken along lines XXI—XXI in FIG. 20.
Figure 22:
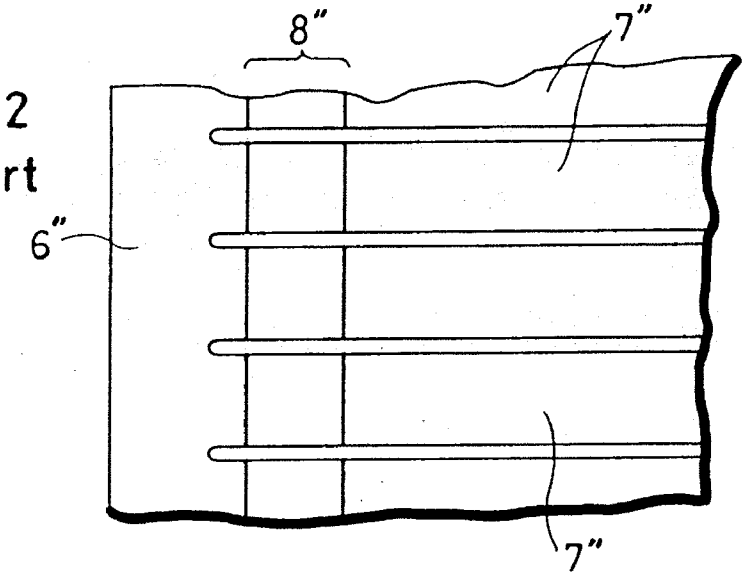
Fig. 22 Prior Art
FIG. 22 is a plan view showing the prior art printhead.
Figure 23:
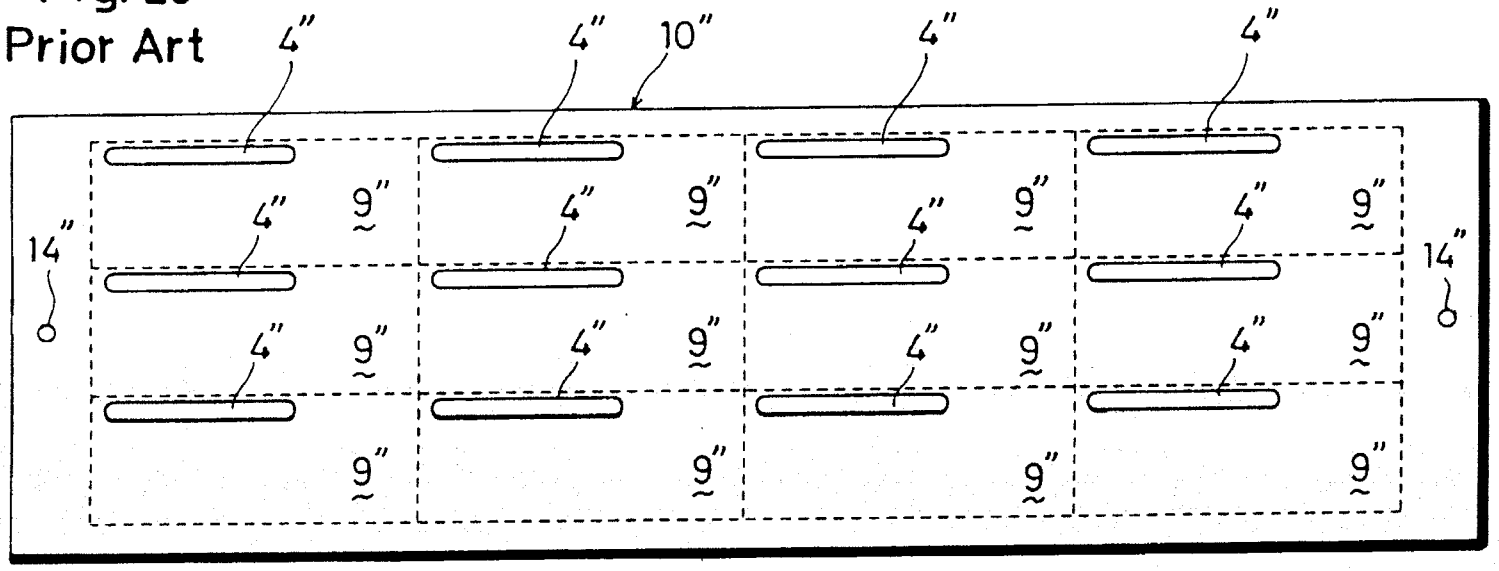
Fig. 23 Prior Art
FIG. 23 is a plan view showing a master substrate from which the prior art printhead may be made.
Figure 24:
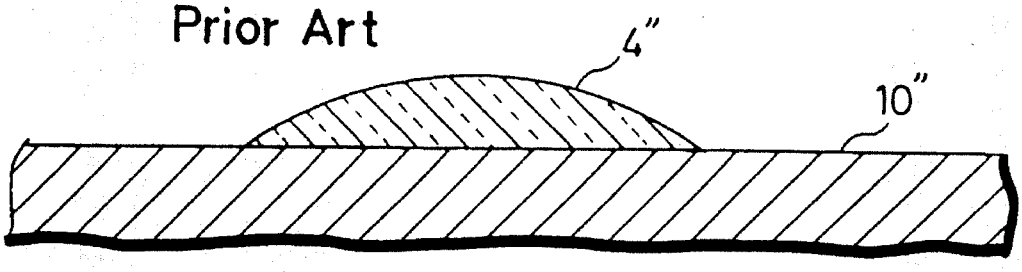
Fig. 24 Prior Art
FIG. 24 is a sectional view showing a glaze strip formed on the master substrate.

Referring first to FIG. 1 of the accompanying drawings, there is shown a serial-type thermal printhead which can be advantageously made by a method according to the present invention. The printhead may have the same structure as that shown in FIG. 21.

Specifically, as shown in FIG. 1, the thermal printhead comprises an insulating head substrate 1 and a partial head glaze strip 4 formed on the head substrate 1 adjacent to one longitudinal edge thereof. A patterned resistor layer 5 is formed on the head substrate 1 and glaze strip 4, whereas a patterned conductor layer is formed on the resistor layer 5 to provide a common electrode 6 and a plurality of individual electrodes 7. The individual electrodes 7 are spaced from the common electrode 6 at the corner or apex 11 of the glaze strip 4, so that the patterned resistor layer 5 provides an array of heating dots 8 along the apex 11 of the glaze strip 4. Further, a protective layer 24 is formed on the patterned conductor layer 6, 7.

The thermal printhead having the above structure may be manufactured in the following manner.

Figure 2:
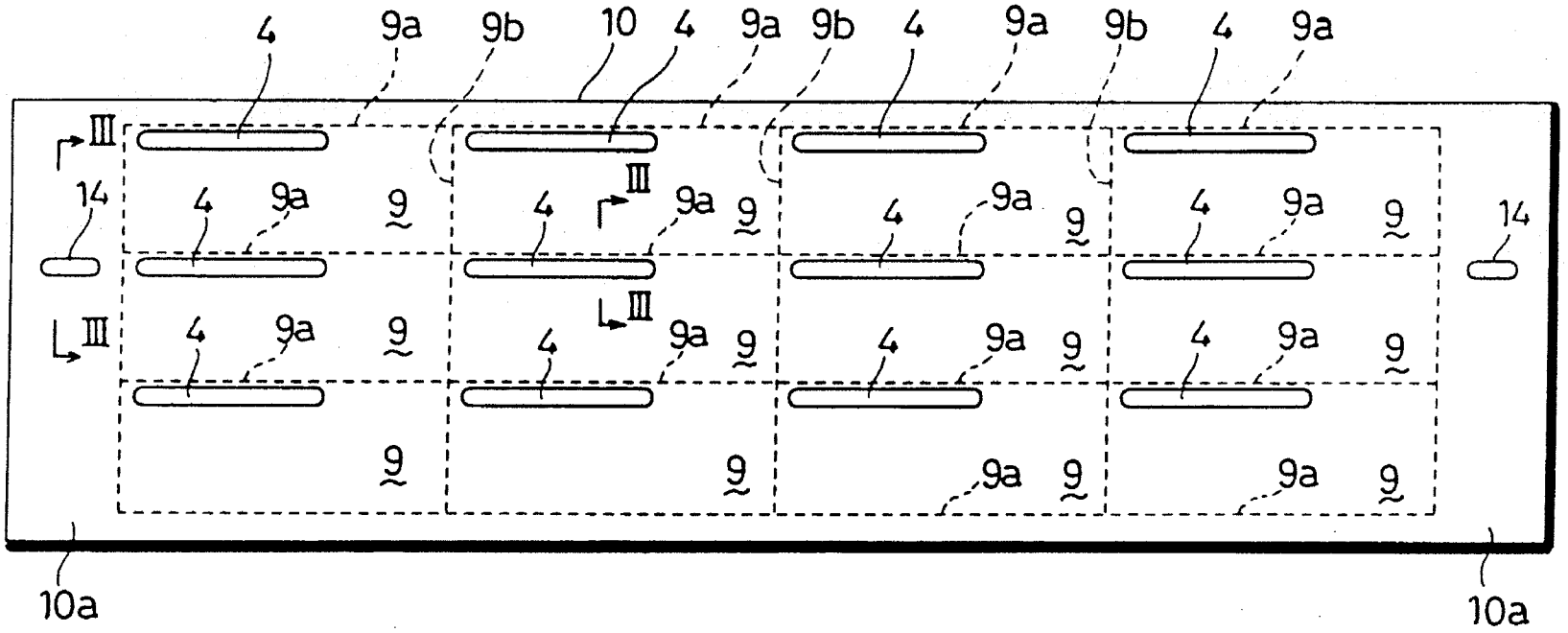
FIG. 2 is a plan view showing a master substrate from which the printhead shown in FIG. 1 may be made.

First, as shown in FIG. 2, a master substrate 10 made of an insulating material such as alumina is prepared. The master substrate 10 has a matrix of unit head regions 9 which are subsequently divided along longitudinal and transverse divisional lines 9*a*, 9*b*. According to the illustrated example, the master substrate 10 has a four-by-three matrix (4×3 matrix) of unit head regions 9. Apparently, each of the unit head regions 9 corresponds to a single head substrate (see the element 1 in FIG. 1). Further, the master substrate 10 has a pair of excess marginal portions 10*a*.

Then, as also shown in FIG. 1, head glaze strips 4 are formed on the master substrate 10 in the respective unit head regions 9 adjacent to and along the respective longitudinal divisional lines 9*a*. At this time, a pair of dummy glaze strips 14 are also formed on the excess marginal portions 10*a* of the master substrate 10 in alignment with the central longitudinal array of glaze strips 4.

Figure 3:
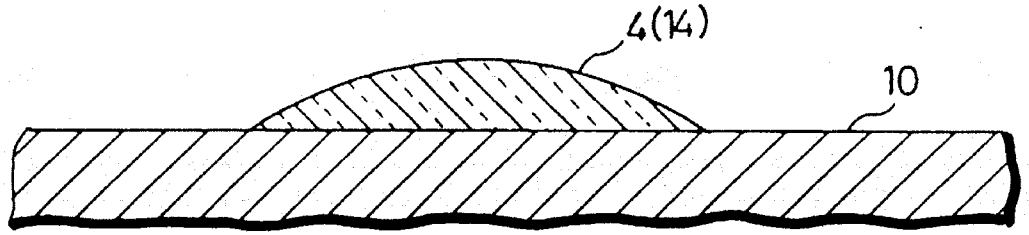
FIG. 3 is a sectional view of the master substrate taken on lines III—III in FIG. 2.

The head and dummy glaze strips 4, 14 may be formed by printing a glass paste with the use of a single screen (not shown) and thereafter baking the glass paste for curing. Due to the surface tension of the glass paste, each of the strips 4, 14 will have a generally arcuate outer surface, as shown in FIG. 3.

Figure 4:
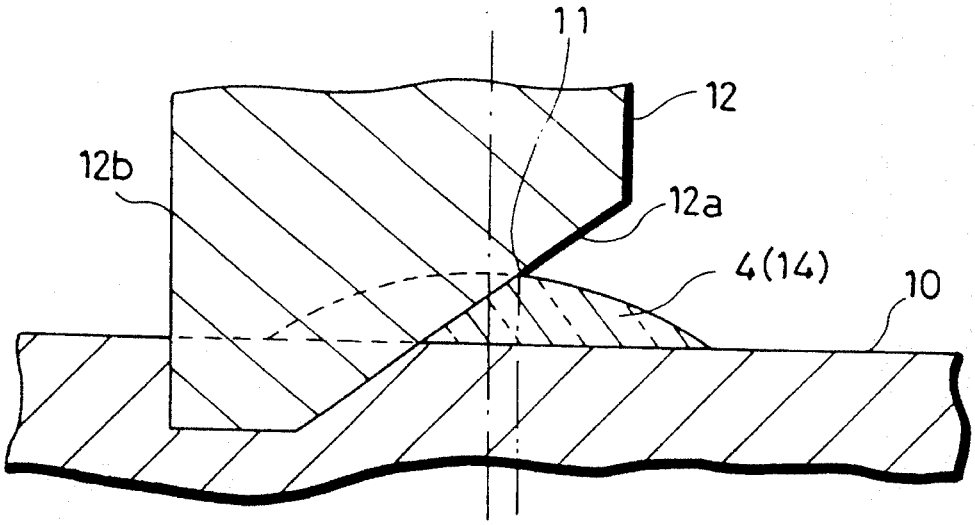
FIG. 4 is a is a sectional view showing a half-cutting step of the inventive method.

Then, as shown in FIG. 4, the master substrate 10 is subjected to a half-cutting step along each of the head and dummy glaze strips 4, 14. The half-cutting step may be performed by using a half-cutting dicing blade 12 which has an inclined edge face 12*a* and a vertical side face 12*b*.

According to the illustrated embodiment, the half-cutting step is accurately performed by utilizing three kinds of positioning marks which include a blade positioning mark 15, a cut width confirmation mark 16, and a glaze corner confirmation mark 17. These marks are formed in a predetermined geometrical relation to each other and to each of the head and dummy glaze strips 4, 14.

The blade positioning mark 15 includes a blade guide line 15*a* with which the vertical side face 12*b* of the dicing blade 12 is aligned while cutting along each of the glaze strips 4, 14, and a deviation indicator 15*b* crossing the blade guide line 15*a* for indicating how much the vertical side face 12*b* of the dicing blade 12 deviates laterally from the guide line 15*a*. Preferably, the blade guide line 15*a* is made to extend over the entire cutting stroke of the dicing blade 12, whereas the deviation indicator 15*b* is positioned adjacent to each end of the blade guide line 15*a*. The deviation indicator 15*b* has an array of three suitably sized triangles extending transversely of the blade guide line 15*a*, and the central one of the three triangles is located on the blade guide line 15*a*. Thus, the degree of deviation of the blade side face 12*b* (namely, the cut line CL1 formed by the blade side face 12*b*) from the blade guide line 15*a* (namely, the correct position) can be visually recognized by referring to the triangles of the deviation indicator 15*b*.

The cut width confirmation mark 16 is in the form of a deviation indicator which includes an array of three suitably sized triangles extending transversely of each glaze strip 4, 14 adjacent thereto. The cut width confirmation mark 16 is used for visually confirming whether the cut line CL2 formed by the inclinded edge face 12*a* of the dicing blade 12 at the surface of the master substrate 10 is accurately located. In other words, the cut width confirmation mark 16 indicates whether the width (and depth as well) of the half-cut formed by the dicing blade 12 is proper. Apparently, the width of the half-cut formed by the dicing blade 12 is considered proper if the cut line CL2 passes through the central one of the three triangles.

The glaze corner confirmation mark 17 also has an array of three suitably sized triangles formed on each glaze strip 4, 14 to extend transversely thereof. The glaze corner confirmation mark 17 is used for visually confirming whether the glaze corner or apex 11 formed by the inclinded edge face 12*a* of the dicing blade 12 is accurately located. Apparently, the glaze corner 11 is considered properly positioned if the corner line CL3 (which is another cut line formed by the inclined edge face 12*a* of the dicing blade 12) passes through the central one of the three triangles.

As described above, the three kinds of positioning marks 15–17 may be provided with respect to each of the glaze strips 4, 14. However, it may be sufficient to provide such positioning marks only with respect to each of the dummy glaze strips 14 if the dicing apparatus is designed to automatically half-cutting the master substrate 10 with respect to all the longitudinal rows of unit head regions 9 with positional accuracy on the basis of a single positional reference.

The positioning marks 15–17 may be formed simultaneously by a conventional photolithographic method. Specifically, an etchable film of e.g. aluminum is first formed over the entire surface of the master substrate 10 by sputtering, vapor deposition, screen-printing or the like. Then, a resist layer is formed over the etchable film. Then, the resist layer is covered by a photomask and patterned by exposure to light followed by development. Then, the portions of the etchable film not covered by the patterned resist layer is etched away. Finally, the patterned resist layer is removed. Apparently, the remaining portions of the etchable film correspond to the positioning marks 15–17.

Figure 6:
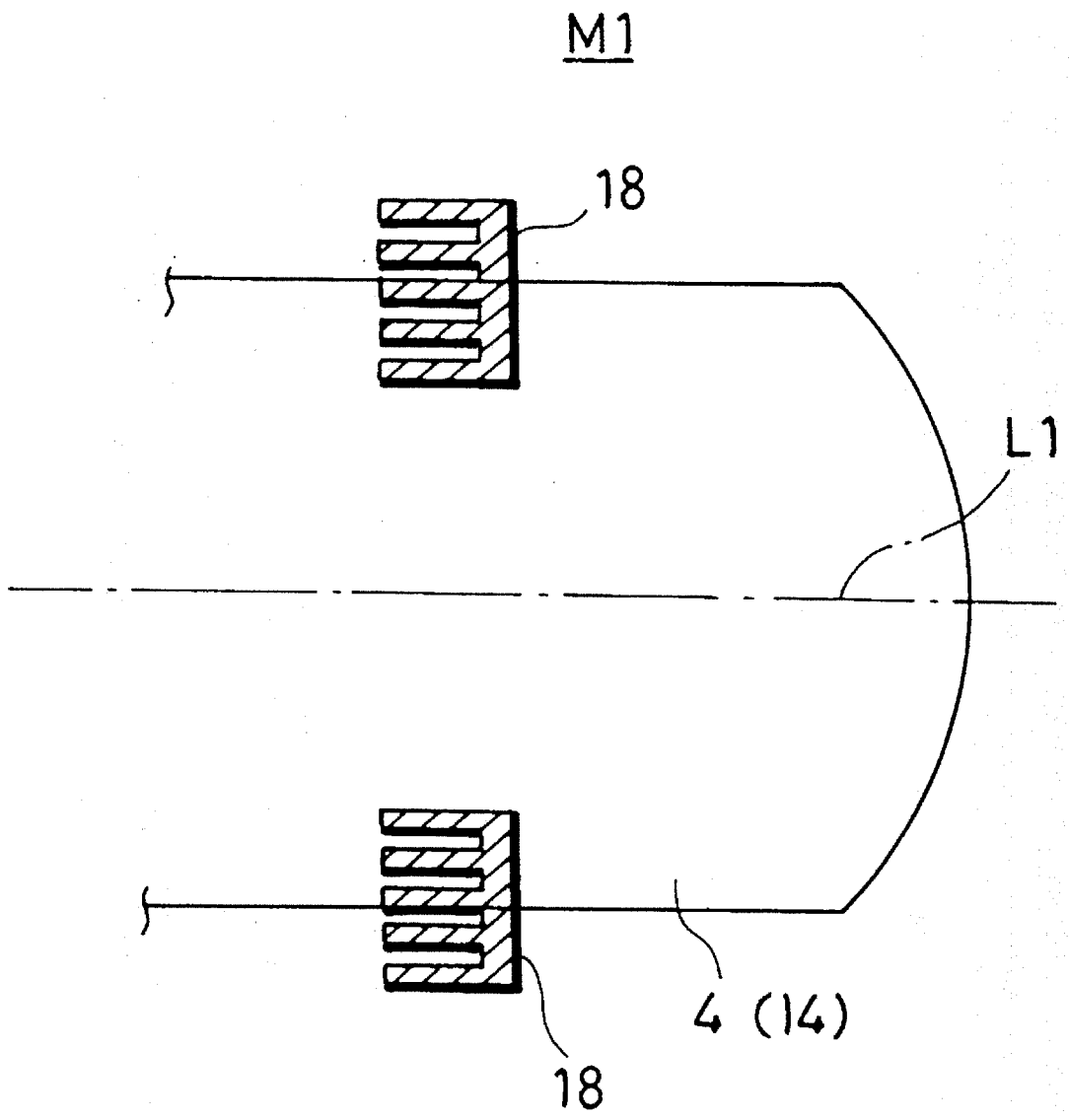
FIG. 6 is a plan view showing a photomask used for forming the positioning marks illustrated in FIG. 5.

For accurately positioning the photomask relative to the master substrate 10 (namely, the resist layer), the photomask may preferably have mask alignment marks. Specifically, as shown in FIG. 6, the photomask represented by reference sign M1 may be provided with comb-like mask alignment marks 18 each having five comb teeth for alignment with a longitudinal edge of each glaze strip 4, 14. Alternatively, the mask alignment marks 18 may be used for positional adjustment of the photomask M1 by referring to the longitudinal center line L1 of the glaze strip 4, 14.

Of the three kinds of positioning marks 15–17, only the blade positioning mark 15 is essential for accurately performing the half-cutting step. This is because the dicing apparatus used for the half-cutting step can be designed to automatically provide a cut of a predetermined width and depth once the position of the dicing blade 12 (FIG. 4) is accurately determined. The cut width confirmation mark 16 and glaze corner confirmation mark 17 are used only for confirming whether the formed cut is actually proper and for re-adjusting the cutting condition if the formed cut is found improperly positioned.

Figure 5:
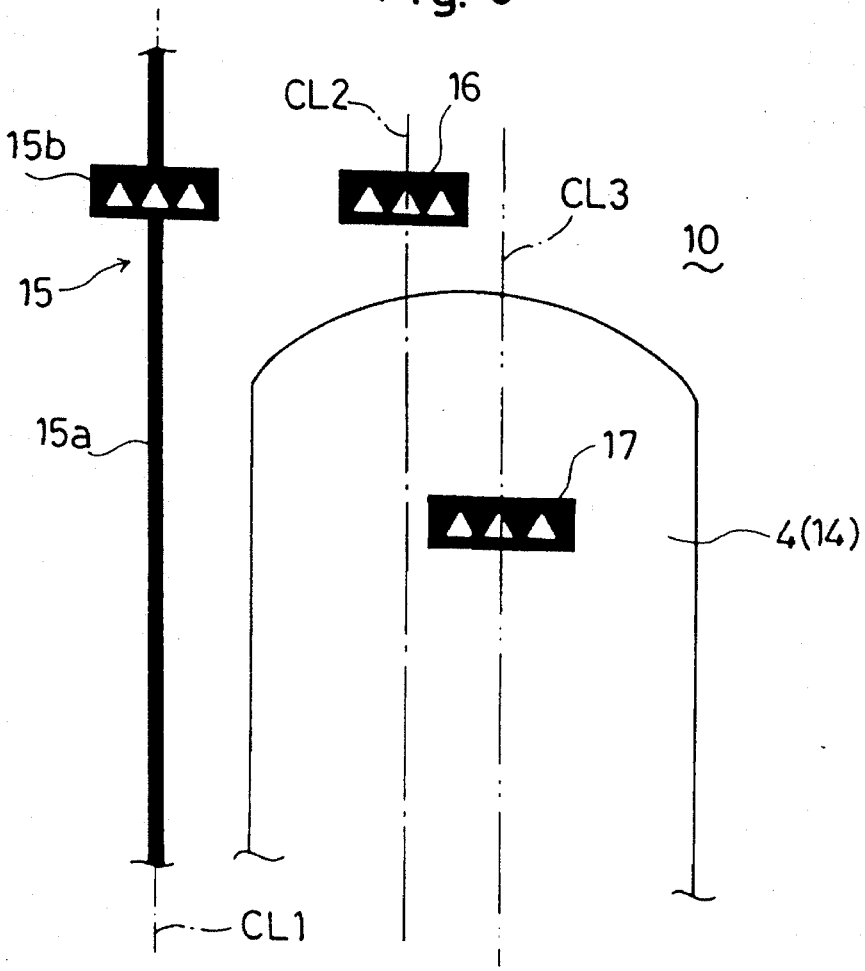
FIG. 5 is a plan view showing three different kinds of positioning marks used for the half-cutting step.

Further, each of the positioning marks 15–17 may be made to have a configuration which is different from that shown in FIG. 5. Moreover, the positioning marks 15–17 may be formed by any conventional method other than photolithography.

Figure 7:
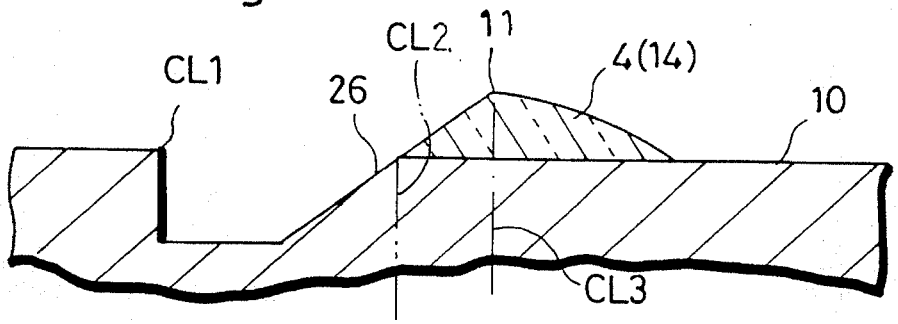
FIG. 7 is a sectional view showing the master substrate after performing the half-cutting operation.
Figure 8:
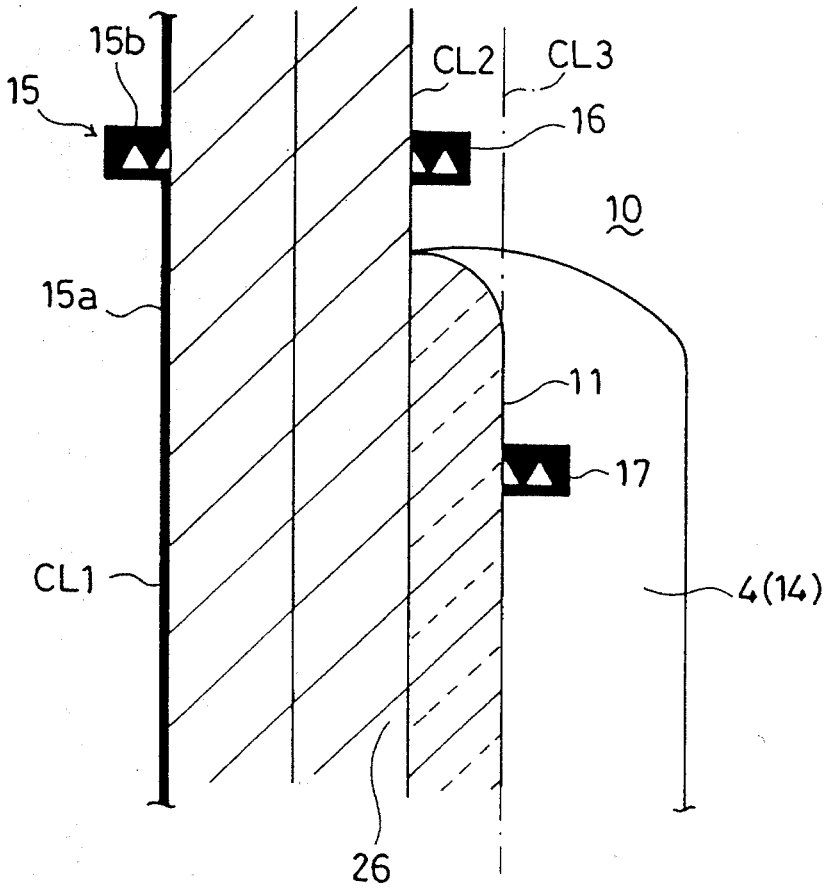
FIG. 8 is a plan view showing the master substrate after performing the half-cutting operation.

FIGS. 7 and 8 illustrate the master substrate 10 upon completion of the half-cutting step. If the half-cutting step is properly performed, the cut line CL1 formed by the side face 12*b* of the dicing blade 12 passes through the central triangle of the deviation indicator 15*b* of the blade positioning mark 15 along the blade guide line 15*a*, whereas the cut line CL2 formed by the inclined edge face 12*a* of the dicing blade 12 at the surface of the master substrate 10 passes through the centeral triangle of the cut width confirmation mark 16. Further, the cut line CL3 (namely, the glaze corner 11) formed also by the inclined edge face 12*a* of the dicing blade 12 at the surface of each glaze strip 4, 14 passes through the central triangle of the glaze corner confirmation mark 17. Indicated by reference numeral 26 in FIG. 7 is an inclined surface formed by the inclined edge face 12*a* of the dicing blade 12 (see FIG. 4).

On the other hand, if the half-cutting step is improper, the positional deviation of the respective cut lines CL1–CL3 may be visually recognizable by referring to the respective marks 15–17. Thus, the half-cut provided by the dicing blade 12 may be immediately readjusted.

As can be appreciated from FIG. 4, the half-cutting step is preferably performed so that the glaze corner 11 is located at the longitudinal center line of each non-cut glaze strip 4, 14 or slightly offset inwardly from the longitudinal center. Such a half-cut ensures that the formed glaze corner 11 is located at the highest position of the cut glaze strip 4.

It should be appreciated that the half-cutting step is performed continuously over the entire length of the master substrate 10 with respect to each longitudinal row of head glaze strips (see FIG. 2). As a result, each of the head glaze strips 4 and dummy glaze strips 14 is made to have a substantially identical cross section because the dummy glaze strips 14 are formed in alignment with the central longitudinal row of head glaze strips 4.

Figure 9:
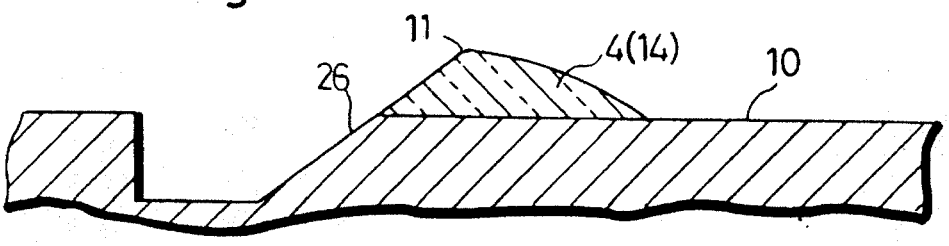
FIG. 9 is a sectional view showing the master substrate after a surface smoothening treatment.

After completing the half-cutting step, the positioning marks 15–17 remaining on the master substrate 10 and each glaze strip 4, 14 are removed, and the master substrate 10 is subjected to thermal or chemical treatment for removing cutting burrs. As a result, the surface of the glaze strip 4, 14 is smoothened (particularly, at the corner or apex 11), as shown in FIG. 9.

Figure 10:
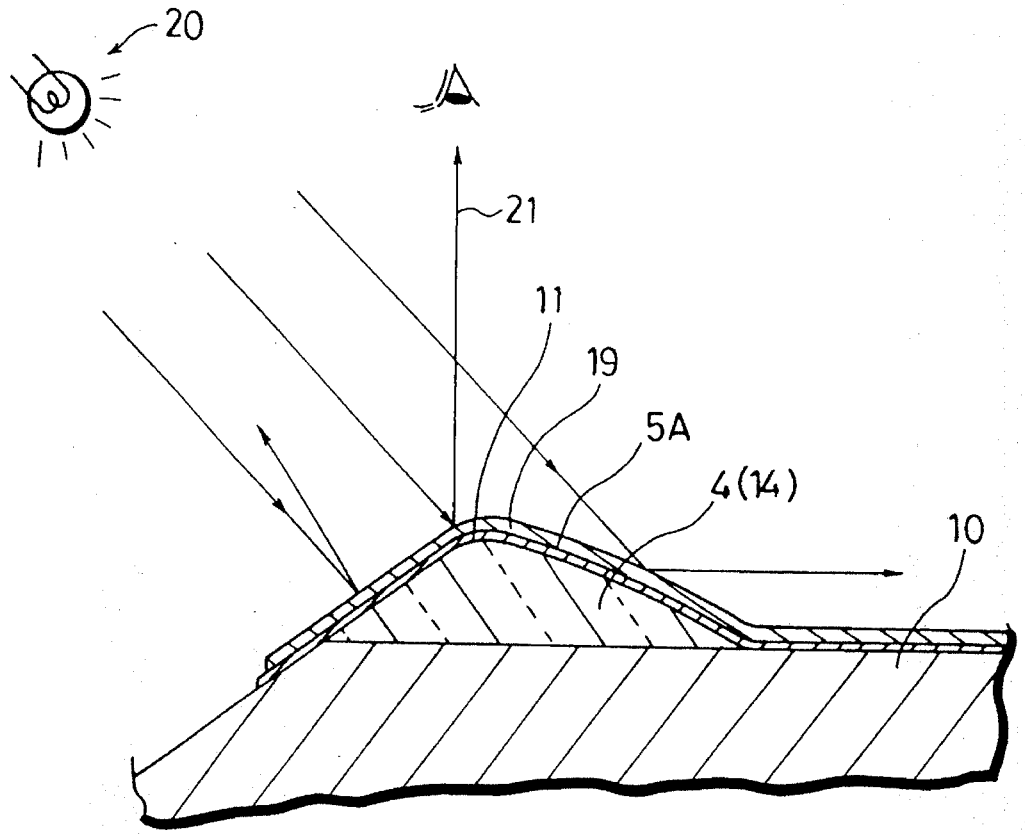
FIG. 10 is a sectional view showing how to form a highlight band as a reference for mask alignment at the time of etching resistor and conductor layers formed on the master substrate.

Then, as shown in FIG. 10, a thin resistor layer 5A is uniformly formed on the master substrate 10 and each glaze strip 4, 14 by sputtering for example. Further, a thin conductor layer 19 is uniformly formed on the resistor layer 5A again by sputtering for example, as also shown in FIG. 10.

Then, the resistor layer 5A together with the conductor layer 19 is subjected to photolithography for etching these layers in a predetermined pattern (see FIG. 1). At this time, a suitably patterned resist layer (not shown) is formed on the conductor layer 19. The patterning of the resist layer is performed by using a photomask which is properly positioned relative to the master substrate 10. The accurate positioning of the photomask may be realized in the following manner.

Figure 11:
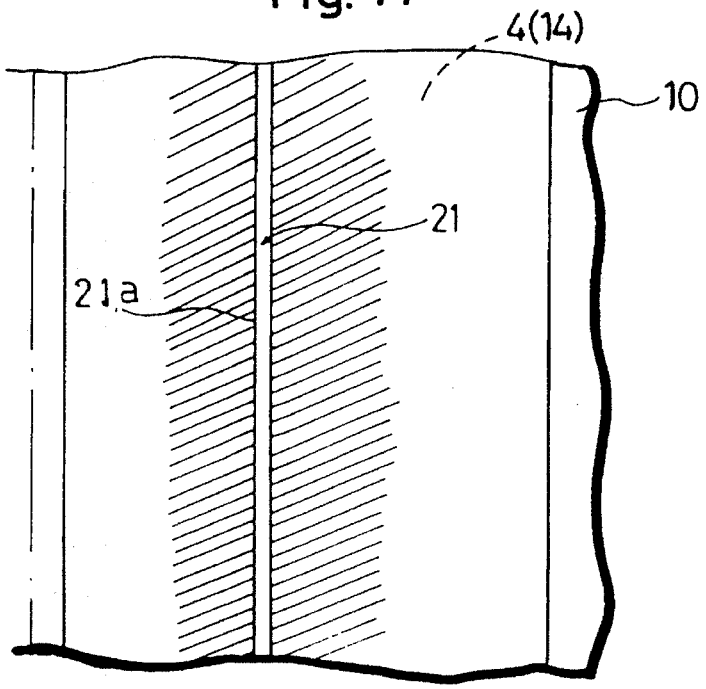
FIG. 11 is a plan view showing the highlight band.

As shown in FIG. 10, a light source 20 arranged obliquely above each glaze strip 4, 14 is made to irradiate the glaze strip for light reflection thereon. Due to the vertically oriented light reflection near the glaze corner 11, a highlight band 21 is formed at or near the glaze corner 11 when viewed from above, as shown in FIG. 11. Therefore, this line 11 may be usable as a reference line for properly positioning the photomask.

Figure 12A:
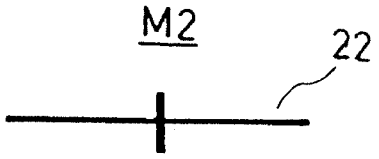
FIG. 12*a* is a plan view showing a photomask used for etching the resistor and conductor layers.

As shown in FIG. 12*a*, the photomask represented by reference sign M2 is provided with a mask alignment mark 22 (consisting of cross lines for example) corresponding to each glaze strip 4, 14.

Figure 13:
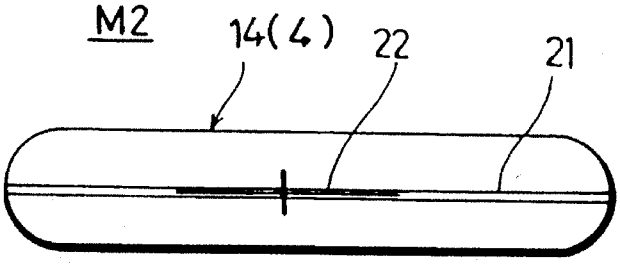
FIG. 13 is a plan view showing the photomask of FIG. 12*a* as aligned with the highlight band.

In use, the mask alignment mark 22 of the photomask M2 is aligned with the highlight band 21 of the glaze strip 4, 14, as shown in FIG. 13.

Figure 12B:
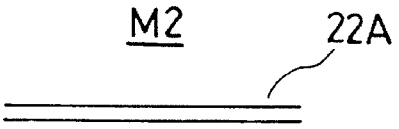
FIG. 12*b* is a plan view showing another photomask used for etching the resistor and conductor layers.

Alternatively, the photomask M2 may be provided with a differently configured mask alignment mark 22A (consisting of two parallel lines), as shown in FIG. 12*b*.

If the curvature radius of the glaze corner 11 is small enough, the highlight band 21 is a small width line. In this case, the mask alignment mark 22 of the photomask M2 may be aligned with the highlight line 21 itself, as shown in FIG. 13. Preferably, the curvature radius of the glaze corner 11 may be no larger than 2,000 micrometers.

On the other hand, if the curvature radius of the glaze corner 11 is relatively large, the highlight band 21 will also have a relatively large width. In this case, the mask alignment mark 22 of the photomask M2 may be aligned with a longitudinal edge 21*a* (see FIG. 11) of the highlight band 21 for conveniently performing the mask alignment.

As previously described, the light source 20 may be made to obliquely irradiate each glaze strip 4, 14. Such oblique irradiation is preferred for rendering the highlight band 21 sufficiently narrow. However, the narrow highlight band 21 tends to be offset slightly toward the light source 20 from the glaze corner 11, as shown in FIG. 10. Thus, this offset need be compensated for at the time of aligning the photomask M2 relative to the master substrate 10 or at the time of forming the mask alignment mark 22 on the photomask M2.

Instead of irradiating each of the head glaze strips 4 and dummy glaze strips 14, it may suffice to irradiate only the dummy glaze strips 14 at the time of performing the mask alignment. Indeed, the reliance on the dummy glaze strips 14 alone for mask alignment makes it possible to standardize the mask alignment apparatus for different kinds of master heads as long as the position of the dummy glaze strips 14 is fixed. Further, the provision of the two dummy glaze strips 14 (instead of one) each combined with the mask alignment mark 22 of the photomask M2 also makes it possible to angularly adjust the photomask M2 relative to the master substrate 10.

Figure 14:
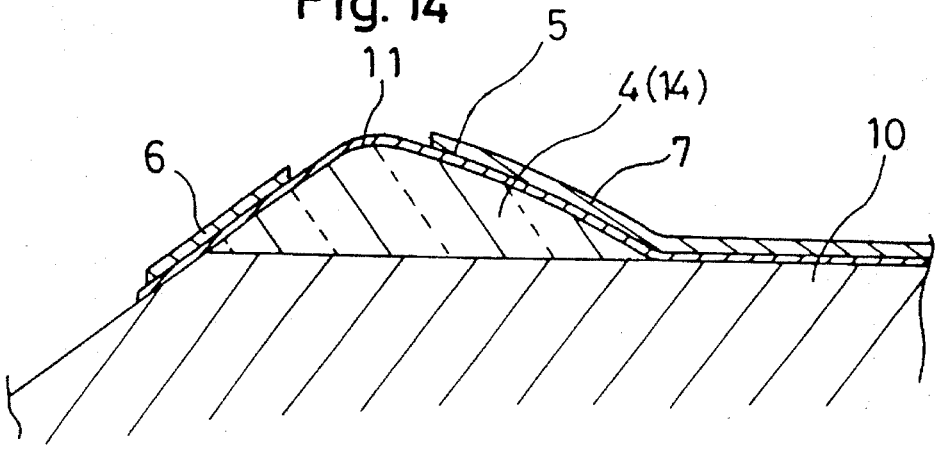
FIG. 14 is a sectional view showing the resistor and conductor layers which have been etched or patterned.
Figure 15:
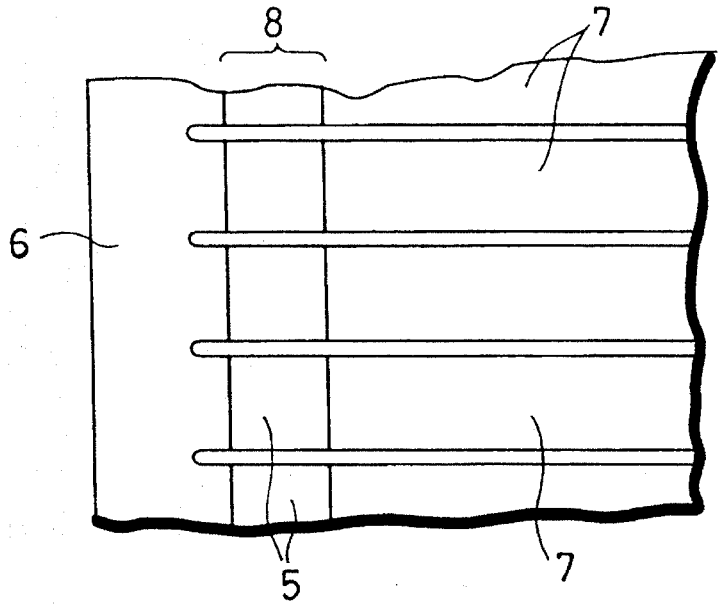
FIG. 15 is a plan view showing the patterned resistor and conductor layers.

The above etching of the resistor layer 5A and conductor layer 19 results in the formation of a patterned resistor layer 5, a common electrode 6 and a plurality of individual electrodes 7, as shown in FIGS. 14 and 15. The portions of the patterned resitor layer 5 located at the glaze corner 11 work as heating dots 8. Upon completion of the etching step, the portions of the resistor layer (not shown) remaining on the common electrode 6 and individual electrodes 7 are removed away.

Figure 16A:
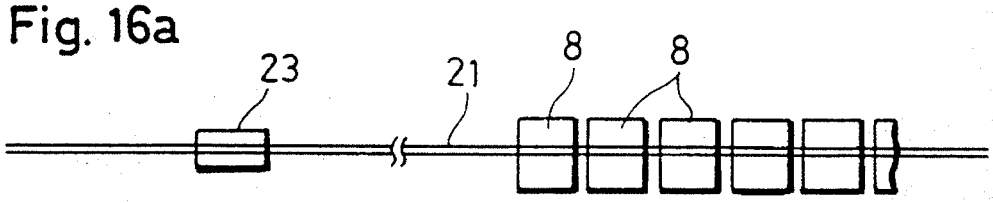
FIGS. 16*a* through 16*d* are plan views showing four different patterns used for positionally confirming a heat dots array.

Preferably, as shown in FIG. 16*a*, a dots array confirmation pattern 23 may be formed on each dummy glaze strip 14 (FIG. 13) simultaneously with etching the conductor layer 19 (FIG. 10). In this case, the photomask M2 (FIG. 12*a*) for etching the conductor layer 19 may be also used for etching the dots array confirmation pattern 23, so that the dots array confirmation pattern 23 can be formed in a predetermined positional relation to the array of heating dots 8.

When each dummy glaze strip 14 with the dots array confirmation pattern 23 is irradiated by the light source 20 (see FIG. 10) after the etching step, the highlight band 21 is again formed by light reflection to indicate whether the array of heating dots 8 is formed in a proper position. Specifically, if the highlight band 21 passes fully through the dots array confirmation pattern 23, it can be confirmed that the array of heating dots 8 is positioned properly because the array of heating dots 8 is in a predetermined positional relation to the dots array confirmation pattern 23. Thus, the positional checking of the heat dots array can be conveniently performed.

Figure 16B:
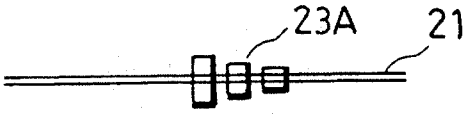
Figure 16C:
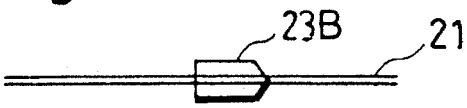
Figure 16D:
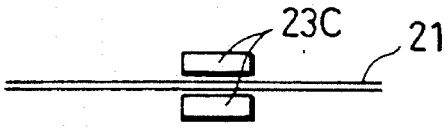

FIGS. 16*b* through 16*d* shows other examples of dots array confirmation pattern which can substitute the dots array confirmation pattern 23 illustrated in FIG. 16*a*. Specifically, the dots array confirmation pattern 23A shown in FIG. 16*b* comprises rectangles of different sizes, whereas the dots array confirmation pattern 23B shown in FIG. 16*c* comprises a strip which has a center indicating apex. Further, the dots array confirmation pattern 23*c* shown in FIG. 16*d* includes a parallel pair of laterally spaced strips.

After the etching operation described above, a protective coating 24 made of glass for example is formed over the patterned conductor and resistor layers except for portions thereof used for mounting drive ICs and for providing electrical connection terminals, as shown in FIG. 1. The formation of the protective coating 24 may be performed by application of a glass paste, sputtering or CVD for example.

Figure 25A:
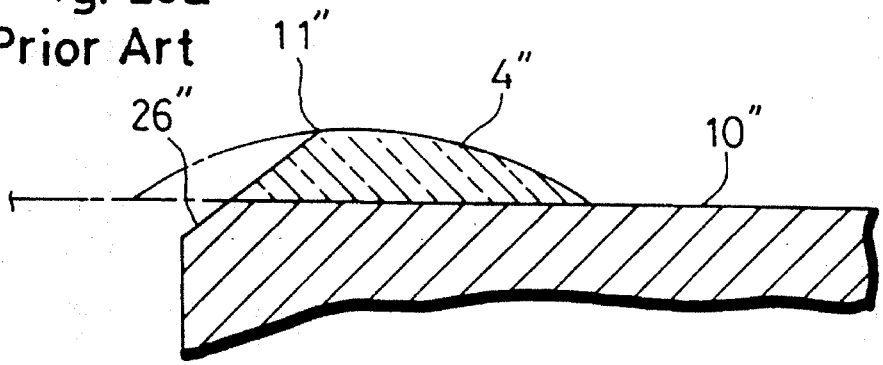
Fig. 25a Prior Art
FIGS. 25*a* and 25*b* are sectional views showing how a glaze corner is improperly formed.
Figure 25B:
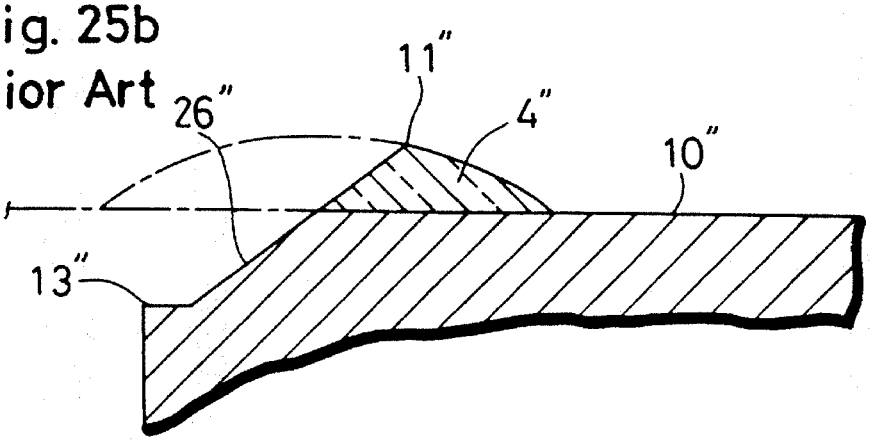
Fig. 25b Prior Art
Figure 26:
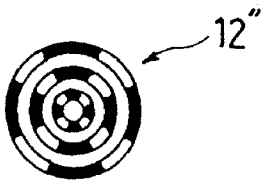
Fig. 26 Prior Art
FIG. 26 is a plan view showing an alignment mark used for mask alignment.

Finally, as also shown in FIG. 1, the master substrate 10 is subjected to a full cutting step wherein a full-cutting dicing blade 25 is made to fully cut the master substrate 10 along the longitudinal and transverse divisional lines 9*a*, 9*b* (FIG. 2) of the master substrate 10. At this time, care need be taken to make sure that the dicing blade 25 engages the master substrate 10 at the inclined surface 26 thereof. Otherwise, the inclined surface may be followed by an undesired platform, as shown in FIG. 25*b*.

Figure 17:
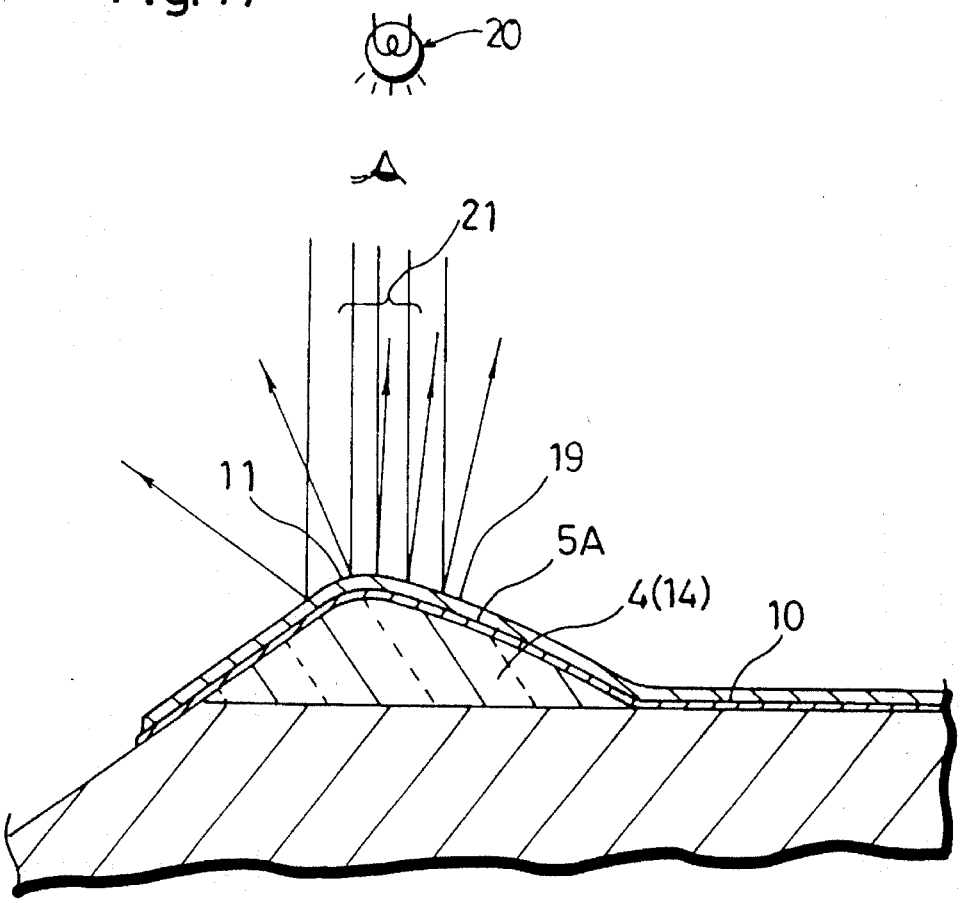
FIG. 17 is a sectional view showing another way of forming a highlight band.
Figure 18:
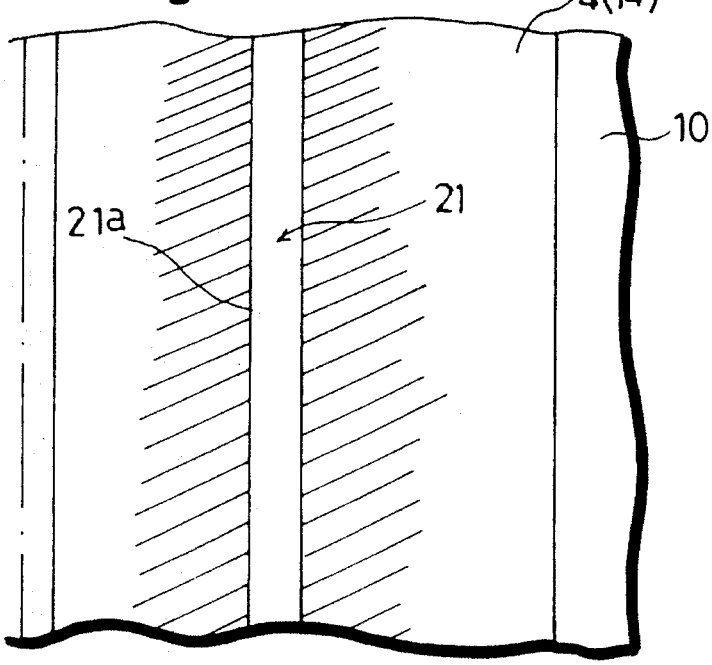
FIG. 18 is a plan view showing the highlight band.

FIGS. 17 and 18 show another embodiment of the present invention wherein the mask alignment prior to etching the resistor layer 5A and conductor layer 19 is performed by a light source 20 which is arranged directly above the glaze corner 11 for vertically irradiating the glaze corner 11. In this case, the highlight band 21 becomes relatively wide, so that a longitudinal edge 21*a* of the highlight band 21 may be conveniently used as a reference line for the mask alignment.

Figure 19:
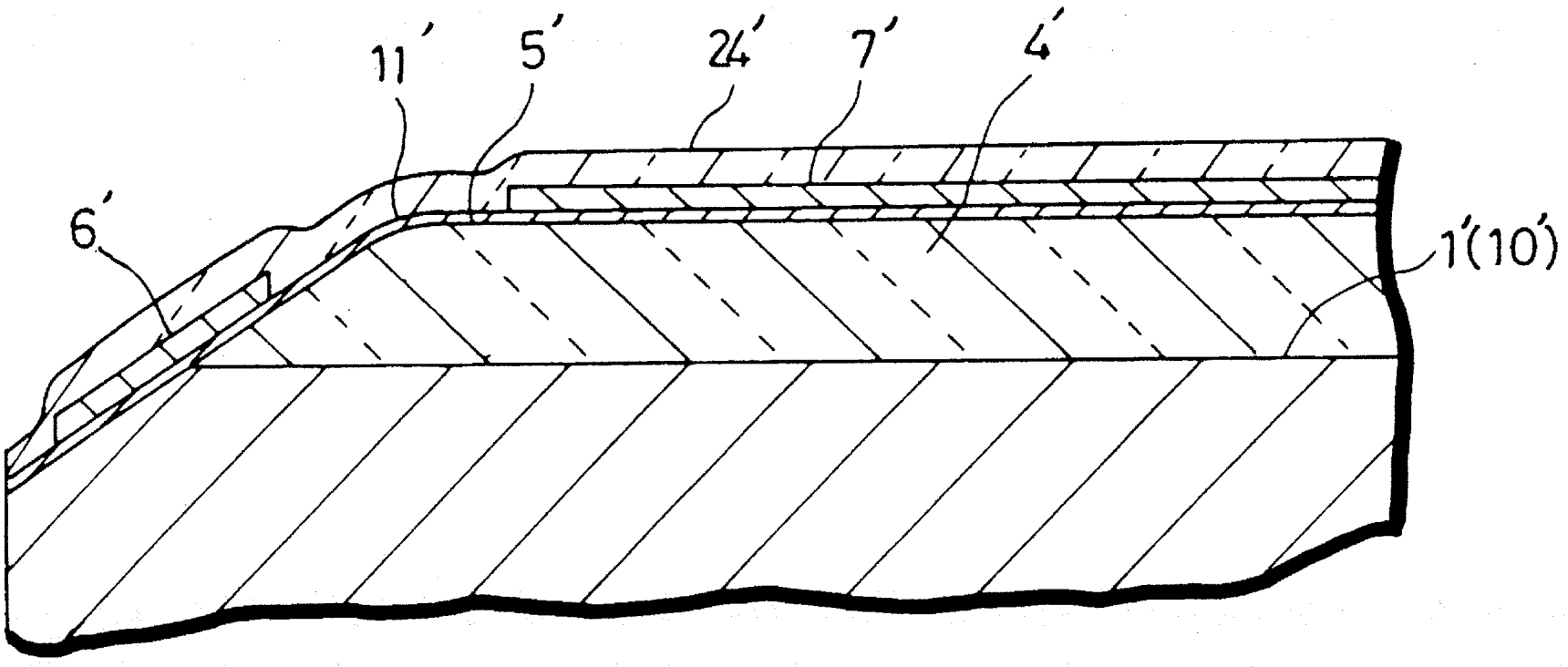
FIG. 19 is a transverse sectional view showing another serial-type thermal printhead which can be advantageously made by a method according to the present invention.
Figure 20:
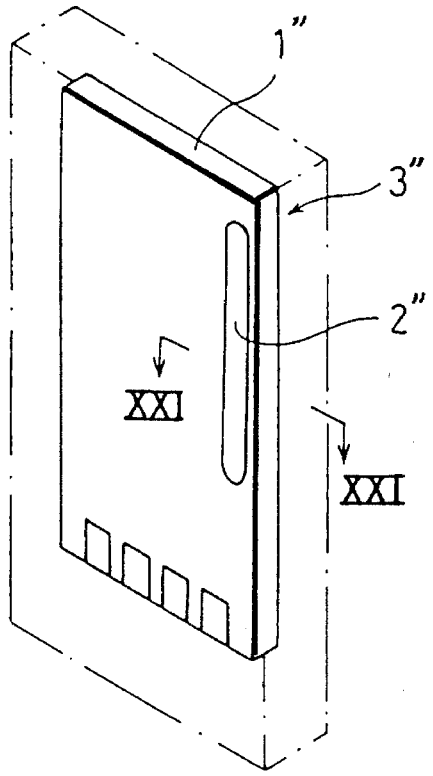
Fig. 20 Prior Art
FIG. 20 is a perspective view showing a prior art thermal printhead.

FIG. 19 shows another example of thermal printhead which can be advantageously made by a method according to the present invention. The printhead comprises a head substrate 1' which is obtained by dividing a master substrate 10', an overall glaze layer 4' formed on the head substrate 1' and having an inclined marginal surface to provide a glaze corner 11', a patterned resistor layer 5', a common electrode 6', a plurality of individual electrodes 7', and a protective layer 24'. Apparently, the three kinds of positioning marks 15–17 (see FIG. 5) may be provided in this example for accurately performing the half-cutting step (glaze corner formation). Further, light irradiation (see FIG. 10) may be also utilized in this example for accurately performing the mask alignment.

The preferred embodiments of the present invention being thus described, it is obvious that the same may be varied in many ways. For instance, the present invention is applicable not only to a serial-type thermal printhead but also to a line-type thermal printhead. Such variations are not to be regarded as a departure from the spirit and scope of the present invention, and all such variations as would be obvious to those skilled in the art are intended to be covered by the appended claims.

We claim:

1. A method of making thermal printheads comprising the steps of:

(a) preparing a master substrate having plural rows of unit head regions;

(b) forming a head glaze member in each unit head region in each row so that an edge of the head glaze member of said each unit head region is aligned with that of the head glaze member of any other unit region in said each row;

(c) half-cutting the master substrate along said edge of the head glaze member of said each unit head region with a half-cutting dicing blade which has an inclined edge face for partially cutting the head glaze member to provide a glaze corner; and (d) forming an array of heating dots along the glaze corner;

wherein at least one blade positioning mark is formed on the master substrate before the half-cutting step (c);

wherein the half-cutting dicing blade is positionally set in the half-cutting step (c) by referring to the blade positioning mark; and wherein the blade positioning mark comprises a plurality of deviation indicators spaced transversely of said edge of the head glaze member.

2. The method according to claim 1, wherein at least one cut width confirmation mark is also formed on the master substrate before the half-cutting step (c).

3. The method according to claim 1, wherein a glaze corner confirmation mark is formed on the head glaze member of at least one unit head region before the half-cutting step (c).

4. The method according to claim 1, wherein at least one dummy glaze member is also formed on the master substrate in the step (b) in a manner such that an edge of the dummy glaze member is aligned with that of the head glaze member of any unit region in a selected row, and a glaze corner confirmation mark is formed on the dummy glaze member before the half-cutting step (c).

5. The method according to claim 1, wherein the step (d) of forming the array of heating dots is performed by photolithography which comprises:

irradiating light beams toward the glaze corner in at least one unit head region to form a highlight band; and positioning a photomask relative to the master substrate by referring to the highlight band.

6. The method according to claim 1, wherein at least one dummy glaze member is also formed on the master substrate in the step (b) in a manner such that an edge of the dummy glaze member is aligned with that of the head glaze member of any unit region in a selected row, the half-cutting step (c) being performed in a manner such that a glaze corner is also formed on the dummy glaze member in alignment with the glaze corner of any unit region in said selected row, the step (d) of forming the array of heating dots being performed by photolithography which comprises:

irradiating light beams toward the glaze corner of the dummy glaze member to form a highlight band; and positioning a photomask relative to the master substrate by referring to the highlight band.

7. A method of making thermal printheads comprising the steps of:

(a) preparing a master substrate having plural rows of unit head regions;

(b) forming a head glaze member in each unit head region in each row so that an edge of the head glaze member of said each unit head region is aligned with that of the head glaze member of any other unit region in said each row;

(c) half-cutting the master substrate along said edge of the head glaze member of said each unit head region with a half-cutting dicing blade which has an inclined edge face for partially cutting the head glaze member to provide a glaze corner; and (d) forming an array of heating dots along the glaze corner;

wherein the step (d) of forming the array of heating dots is performed by photolithography which comprises:

irradiating light beams toward the glaze corner in at least one unit head region to form a highlight band; and positioning a photomask relative to the master substrate by referring to the highlight band.

8. A method of making thermal printheads comprising the steps of:

(a) preparing a master substrate having plural rows of unit head regions;

(b) forming a head glaze member in each unit head region in each row so that an edge of the head glaze member of said each unit head region is aligned with that of the head glaze member of any other unit region in said each row;

(c) half-cutting the master substrate along said edge of the head glaze member of said each unit head region with a half-cutting dicing blade which has an inclined edge face for partially cutting the head glaze member to provide a glaze corner; and (d) forming an array of heating dots along the glaze corner;

wherein the step (b) further comprises forming at least one dummy glaze member on the master substrate in a manner such that an edge of the dummy glaze member is aligned with that of the head glaze member of any unit region in a selected row;

wherein the half-cutting step (c) is performed in a manner such that a glaze corner is also formed on the dummy glaze member in alignment with the glaze corner of any unit region in said selected row; and wherein the step (d) of forming the array of heating dots is performed by photolithography which comprises:

irradiating light beams toward the glaze corner of the dummy glaze member to form a highlight band; and positioning a photomask relative to the master substrate by referring to the highlight band.

9. The method according to claim 8, wherein the step (d) of forming the array of heating dots further comprises simultaneously forming a heating dots confirmation pattern at the glaze corner of the dummy glaze member, the glaze corner of the dummy glaze member being irradiated with light beams to form a highlight band which is referred to for confirming whether the array of heating dots is correctly positioned.

10. The method according to claim 1, wherein each of the deviation indicators comprises a triangle.

* * * * *